US006412128B1

(12) United States Patent
Matthews

(10) Patent No.: US 6,412,128 B1
(45) **Date of Patent: *Jul. 2, 2002**

(54) RESILENT SUPPORT PILLOW AND METHODS

(76) Inventor: Susan H. Matthews, 29753 Canterbury Cir., Evergreen, CO (US) 80439

( * ) Notice: Subject to any disclaimer, the term of this patent is extended or adjusted under 35 U.S.C. 154(b) by 0 days.

This patent is subject to a terminal disclaimer.

(21) Appl. No.: 09/892,063

(22) Filed: Jun. 25, 2001

Related U.S. Application Data

(63) Continuation of application No. 09/662,512, filed on Sep. 14, 2000, now Pat. No. 6,279,185.

(51) Int. Cl.[7] ..... A47G 9/00
(52) U.S. Cl. ..... 5/655
(58) Field of Search ..... 5/490, 655, 636, 5/630, 632, 652, 646

(56) References Cited

U.S. PATENT DOCUMENTS 2,328,871 A * 9/1943 Woehler ..... 5/636
5,154,649 A * 10/1992 Pender ..... 5/655
5,261,134 A 11/1993 Matthews ..... 5/655
5,546,620 A 8/1996 Matthews ..... 5/655
5,661,861 A 9/1997 Matthews ..... 5/633
6,038,720 A 3/2000 Matthews ..... 5/639
6,055,687 A 5/2000 Matthews ..... 5/636
6,119,873 A 9/2000 Matthews ..... 211/49.1

* cited by examiner

*Primary Examiner*—Alexander Grosz
(74) *Attorney, Agent, or Firm*—Townsend and Townsend and Crew LLP

(57) ABSTRACT

A support pillow comprises a cushion body having a medial region and two opposing arms that define an outer perimeter and a generally open well. A cover is disposed about the cushion body and comprises an outer section that extends about the outer perimeter and an inner section that extends about the open well. Further, the inner section has a width in the range from about 1 inch to about 6 inches. Such a configuration facilitates separation of the arms without tearing or damaging the cover while also permitting the pillow to return to its original shape upon release of the arms.

11 Claims, 4 Drawing Sheets

RESILENT SUPPORT PILLOW AND METHODS

CROSS-REFERENCES TO RELATED APPLICATIONS

This application is a continuation application of U.S. application Ser. No. 09/662,512, filed Sep. 14, 2000, now U.S. Pat. No. 6,279,185.

BACKGROUND OF THE INVENTION

This invention relates generally to the field of support pillows, and in particular to support pillows that are suitable for placement around an object. More specifically, the invention relates to support pillows that may be expanded when placed about an object and then returned to their original shape following removal from the object.

Support pillows have been used in a variety of applications. For example, support pillows have been used to support babies in a sitting position, to support babies when lying down, and to be positioned around a person's torso. Support pillows for such applications are described in U.S. Pat. Nos. 5,661,861, 5,546,620, 5,261,134 and 6,055,687, the complete disclosures of which are herein incorporated by reference.

This invention is related to support pillows having alternative designs. In this way, the support pillows may be used in a wide variety of applications.

SUMMARY OF THE INVENTION

In one embodiment, a support pillow comprises a cushion body having a medial region and two opposing arms that define an outer perimeter and a generally open well. A cover is disposed about the cushion body and comprises an outer section that extends about the outer perimeter and an inner section that extends about the open well. Further, the inner section has a width in the range from about 1 inch to about 6 inches. Such a configuration facilitates separation of the arms without tearing or damaging the cover while also permitting the pillow to return to its original shape upon release of the arms.

In one aspect, the cover is constructed of a generally non-stretchable fabric, and the outer section and the inner section are sewn together. Conveniently, the outer section may comprise a pair of fabric pieces that are sewn together at the outer perimeter. In another aspect, the cushion body may be constructed of a polyester fill material.

The components of the support pillow may have a variety of sizes. For example, the medial region may have a height in the range from about 4 inches to about 7 inches, and the well may have a diameter in the range from about 4 inches to about 12 inches when the arms are touching. As another example, the outer perimeter may have a length of about 15 inches to about 45 inches, and the arms may be separated from each other up to about 15 inches to about 45 inches. With such a configuration, the arms may be configured to return to within about 8 inches of each other after the arms have been separated and released.

In another embodiment, a method for using a support pillow is provided. The method utilizes a support pillow comprising a cushion body having a medial region and two opposing arms that define an outer perimeter and a generally open well. A cover is disposed about the cushion body and has an outer section that extends about the outer perimeter and an inner section that extends about the open well. Further, the inner section has a width in the range from about 1 inch to about 6 inches. According to the method, the arms are separated from each other to increase the size of the well, and the arms are placed about an object. For example, the object may comprise a human torso, and a baby may be placed onto the pillow while the pillow is placed about the torso.

In one aspect of the method, the arms are separated by a distance up to about 15 inches to about 45 inches. In another aspect, the support pillow is removed from the object, and upon removal support pillow returns to a shape substantially the same as before being placed about the object. In still another aspect, the ends of the arms are within about 8 inches of each other after removal from the object.

DESCRIPTION OF THE SPECIFIC EMBODIMENTS

The invention provides support pillows having a pair of opposing arms that may be widely separated without tearing or damaging the pillow. In this way, the pillows may more easily be placed about an object. The pillows are also constructed so that they return to their original shape after being removed from the objet. The support pillows may be constructed of a resilient cushion body that is covered by a cover. The cushion body may be constructed of a wide variety of fill materials, including for example, polyester, foam, and the like. In some embodiments, the cover is constructed of a non-stretchable material, such as a fabric. Exemplary fabrics include cotton, polyester, velvet, and the like. Such non-stretchable fabrics permit the pillow to be firmly stuffed with fill materials. When stuffed in this manner, the pillows are able to maintain their shape for extended time periods. Such fabrics also provide an aesthetically pleasing surface.

One convenient way to manufacture such pillows is by joining or sewing multiple pieces of material together to form the cover and then stuffing the fill material into the cover. According to the invention, a center piece of material is joined with one or more other pieces, with the center piece being disposed about the well of the pillow. The center piece has a width that is large enough to permit the arms to be separated and small enough to permit the arms to spring back to their original configuration.

The support pillows of the invention may find used with a variety of applications where the arms are manipulated to be placed around an object. Merely by way of example, such application may include placement about a torso to facilitate nursing, the holding of an object, such as a book, a toy, food, or the like, to function as a back support, or the like. The support pillows of the invention may also find use with the applications described in U.S. Pat. Nos. 5,661,861, 5,546,620, 5,261,134 and 6,055,687, previously incorporated by reference.

Figure 1:
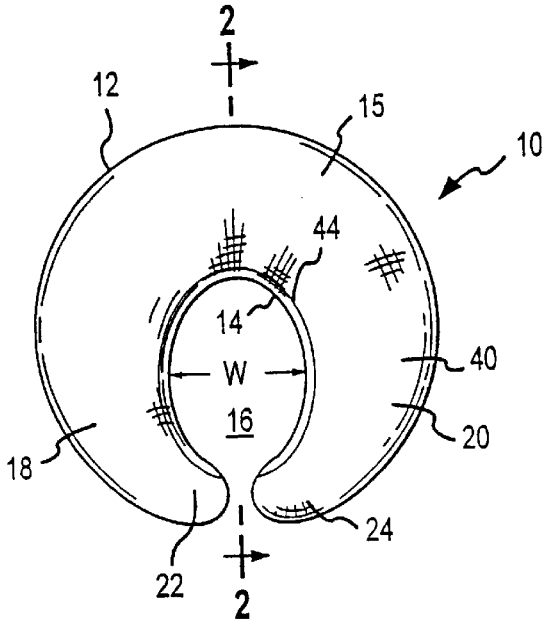
FIG. 1 is a top view of an embodiment of a support pillow according to the invention.

Referring to FIG. 1, an exemplary embodiment of a support pillow 10 will be described. The support pillow 10 may be constructed to have an overall shape and feel that are similar to the support pillows described in U.S. Pat. Nos. 5,661,861, 5,546,620, 5,261,134 and 6,055,687, previously incorporated herein by reference. Support pillow 10 includes a curved outer surface 12 which is rounded in both a longitudinal and a lateral direction to form an outer perimeter. Support pillow 10 further includes a curved central inner surface 14 which defines a rounded, generally circular or elliptical well region 16. While the body of the support pillow 10 is substantially continuous and uniform, with curved surface 12 and 14 also being continuous, it is convenient to consider the pillow body as having a medial region 15 and two opposed arms 18 and 20. The arms 18, 20 extend in opposite directions away from the medial region 15, but are curved towards one another to give the pillow 10 its toroidal configuration. While the continuous structure does not provide a precise or exact division between the medial region 15 and each arm, considering the body of the pillow in view of these components facilitates a description of the structure and function of the pillow 10.

Figure 3:
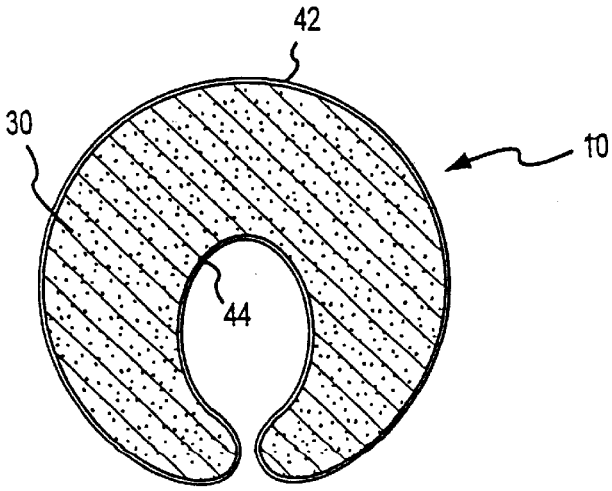
FIG. 3 is a cross sectional view of the support pillow of FIG. 2 taken along lines 3—3.

Arms 18, 20 include respective blunt ends 20 and 24, positioned remotely of the remedial region. Support pillow 10 is proportioned so that ends 22, 24 normally, i.e., when not under external stress, touch or are slightly separated from each another as described herein after. However, ends 22, 24 do not exert substantial pressure against each other, if touching. The toroidal shape defined by the outer and inner curved surfaces 12, 14 is proportioned such that at a central vertical plane, represented by line 2—2 in FIG. 1, bisects pillow 10 at the medial region 15. Pillow 10 thus has bilateral symmetry with respect to the central plane. The central plane further contains a vertical, central axis about which the toroidal pillow body is formed. Profiles of the pillow 10 taken radially of the central axis, i.e., sections of the pillow 10 in planes that also contain the central axis, are elliptical in shape throughout the medial region, and likewise are elliptical throughout the length of each cantilever arm 18, 20 with the exception of blunt ends 22, 24. Perpendicular to the central vertical plane is a horizontal mid-plane that bisects pillow 10 as illustrated in FIG. 3. Hence, pillow 10 is also symmetrical about the mid-plane.

Well region 16 has a width W in the direction perpendicular to the central plane. The width W is selected to permit the support pillow to fit "snug" around the torso or waist of most users. As will be described in greater detail hereinafter, the pillow 10 is constructed so that the arms 18, 20 may be moved away from each other to vary the width W so that the pillow 10 may be used in a variety of applications.

Figure 2:
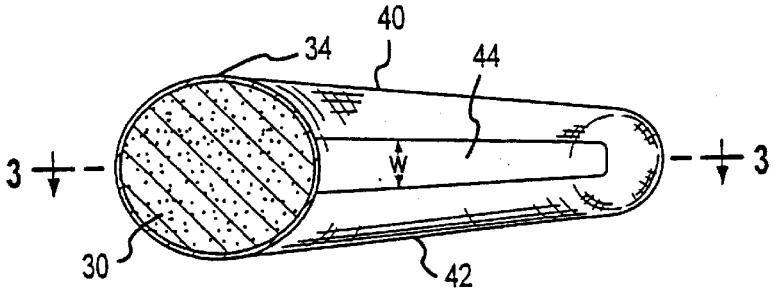
FIG. 2 is a cross sectional view of the support pillow of FIG. 1 taken along lines 2—2.

Referring to FIG. 2, pillow 10 includes a central core 30 which may be constructed of a resilient, compression resistant, hypoallergenic material, such as a polyester filling. The central core 30 is encased by a cover 34, such as cotton or other pliant conforming fabric. The polyester is firmly and tightly packed into cover 34, such that the core 30 and cover 34 together provide a self-supporting pillow body, i.e., the support pillow 10 retains its shape without any sagging or drooping of arms 18, 20 when held at the medial region 15. The tightly packed polyester core 30 also provides the pillow with firmness in the sense that it will undergo only slight elastic deformation (as compared to a conventional pillow) when an object (such as a persons' arms or elbows) is rested on the arms 18, 20 or medial region 15. Line 3—3 in FIG. 2 represents a horizontal mid-plane, with the top and bottom halves of pillow 10 being symmetrical about the mid-plane.

Cover 34 is formed of three pieces of fabric: a top piece 40, a bottom piece 42, and a center piece 44. Top piece 40 and bottom piece 42 are sewn together at the outer perimeter to form a seam 46 (see FIG. 4). Although shown with top piece 40 and bottom piece 42, it will be appreciated that a single piece of fabric may be used to cover the top and bottom of the pillow. Sewn to top piece 40 and bottom piece 42 is center piece 44. In this way, center piece 44 surrounds the inner well, and eliminates a seam running along the mid-plane. Such a configuration permits arms 18 and 20 to be separated without tearing the fabric that is adjacent the inner well. Further, by appropriately configuring the width of center piece 44, cover 34 is sufficiently resilient to spring arms 18 and 20 back to their original shape.

Merely by way of example, when support pillow 10 is configured to be placed about an object having an outer perimeter of about 15 inches to about 45 inches, including, but not limited, the torso of a person, the width of center piece 44 (i.e., width w in FIG. 2) may be configured to permit the ends of the arms 18, 20 to come within about 8 inches, more preferably within about 5 inches, and still more preferably within about 2 inches after removal from the object. As such, center piece 44 may have a width in the range from about 1 inch to about 6 inches when a generally non-stretchable fabric, such as a cotton fabric, is used to cover the core. For such applications, the well 16 may have a diameter of about 4 inches to about 12 inches, more preferably from about 4 inches to about 8 inches, and still more preferably from about 5.5 inches to about 6.5 inches when the ends of the arms are touching. The vertical height of the medial region 15 (when the pillow is lying flat) may be in the range from about 4 inches to about 10 inches, and more preferably from about 4 inches to about 5.5 inches. The height of the arms at their ends 22, 24 may be in the range from about 1 inch to about 6 inches, and more preferably from about 2 inches to about 4 inches. The horizontal thickness of the arms and medial region (when the pillow is lying flat) may be in the range from about 4 inches to about 10 inches, and more preferably from about 4 inches to about 8 inches. The outer perimeter of the pillow may be in the range from about 15 inches to about 45 inches, and more preferably about 30 inches. When the outer perimeter is about 30 inches, the ends of the arms may be separated up to about 17 inches to about 30 inches when center piece 44 has a width from about 1 inch to about 6 inches. The separation distance may increase as the outer perimeter is increased and vice versa. For example, when the outer perimeter is about 45 inches, the ends of the arms may be separated up to about 45 inches as the width of center piece 44 approaches about 6 inches.

Figure 4:
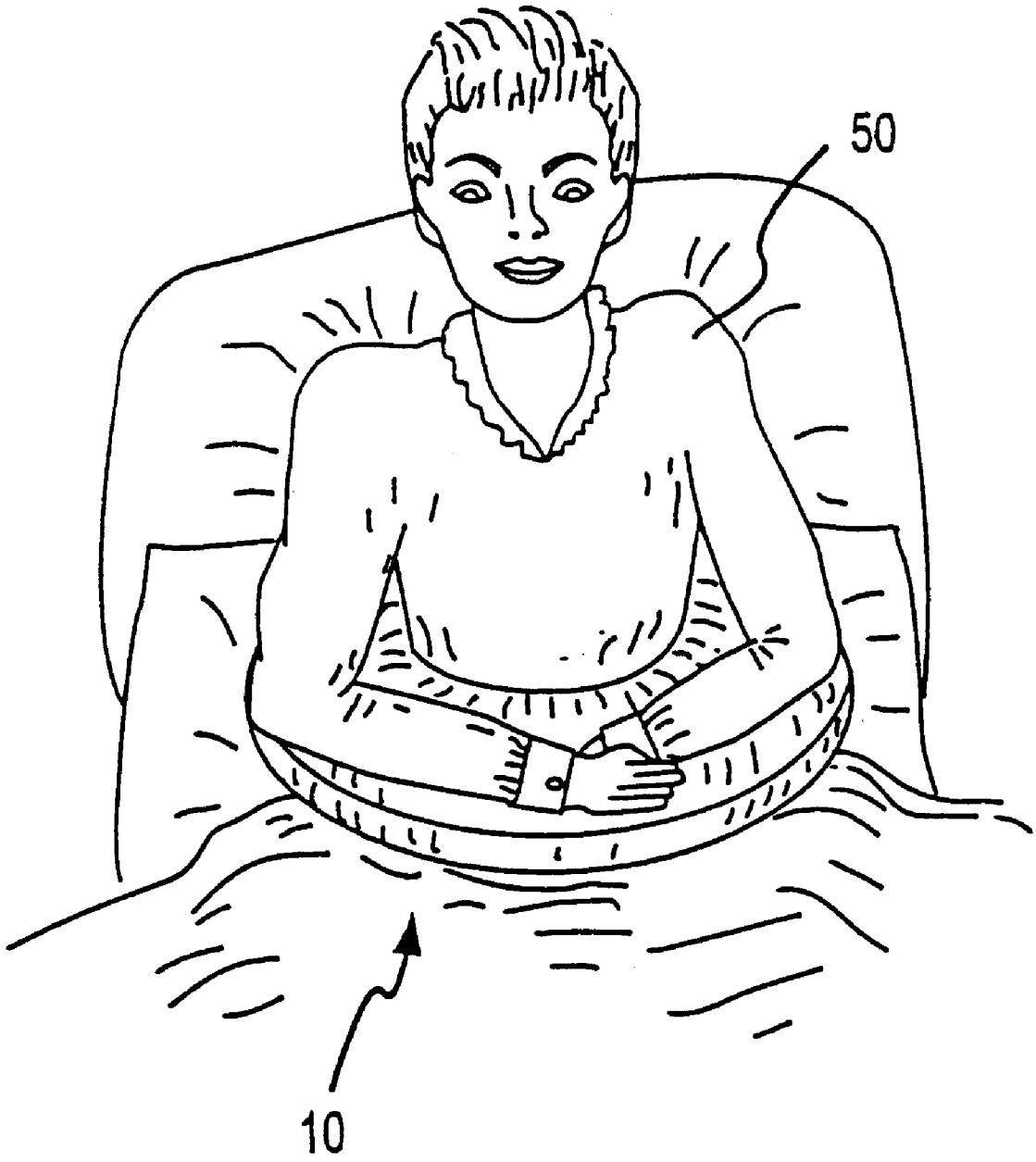
FIG. 4 illustrates the support pillow of FIG. 1 when placed about a person's torso.

As one non-limiting example, pillow 10 may be placed about the torso of a woman 50 as illustrated in FIG. 4. The shape of pillow 10 is particularly useful when sitting in a chair because the arms do not need to fully extend around the woman's back. In the arrangement shown in FIG. 4, the woman may rest a baby on medial region 15 while nursing or holding the baby. By utilizing center piece 44, arms 18 and 20 may be easily separated to permit placement about the torso. By using center piece 44, arms 18, 20 remain resilient to permit arms 18, 20 to "hug" the torso. Further, after removal from the torso, arms 18, 20 spring back to their original shape.

Figure 5:
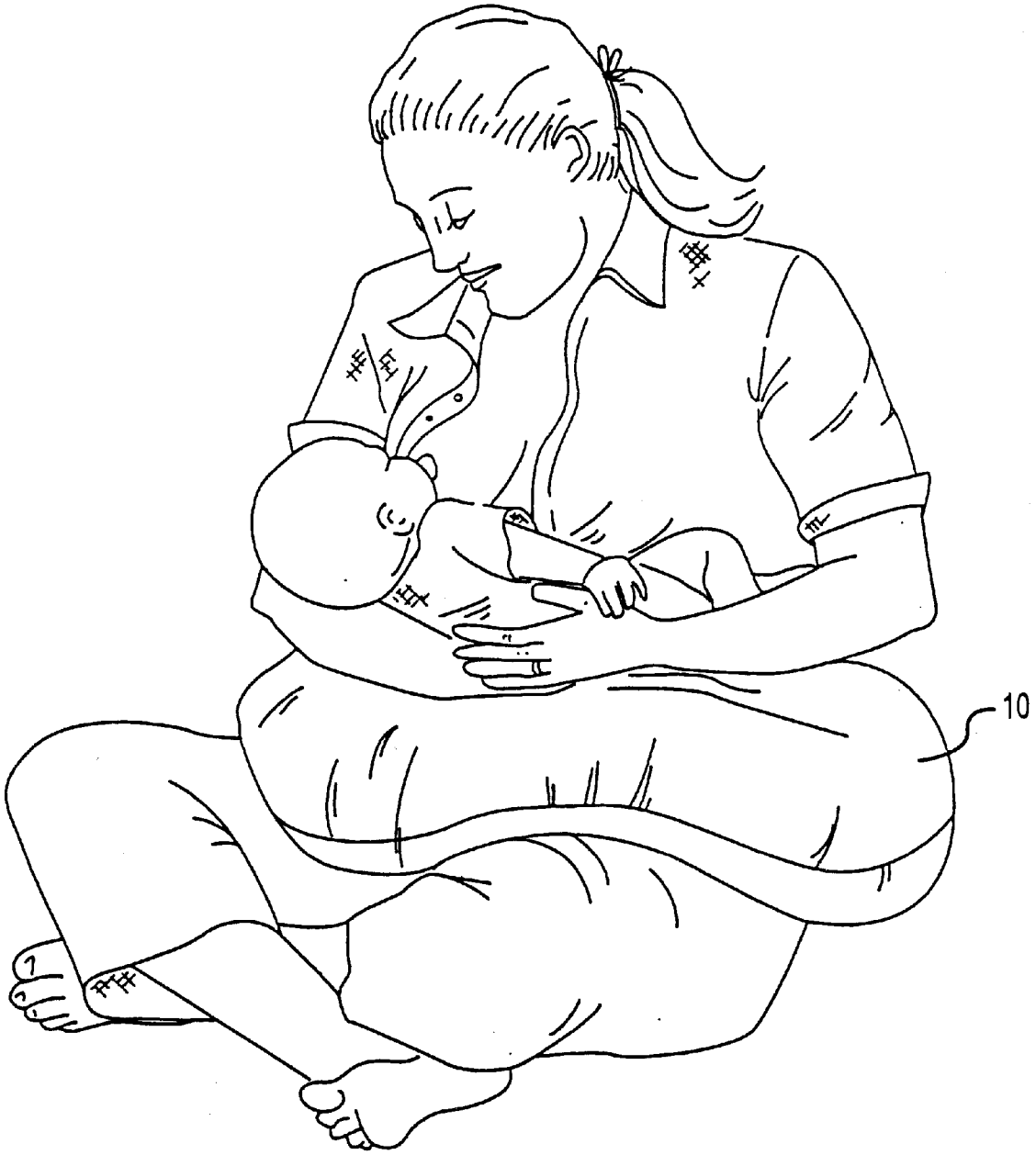
FIG. 5 illustrates the support pillow of FIG. 1 when used to facilitate nursing according to the invention.
Figure 6:
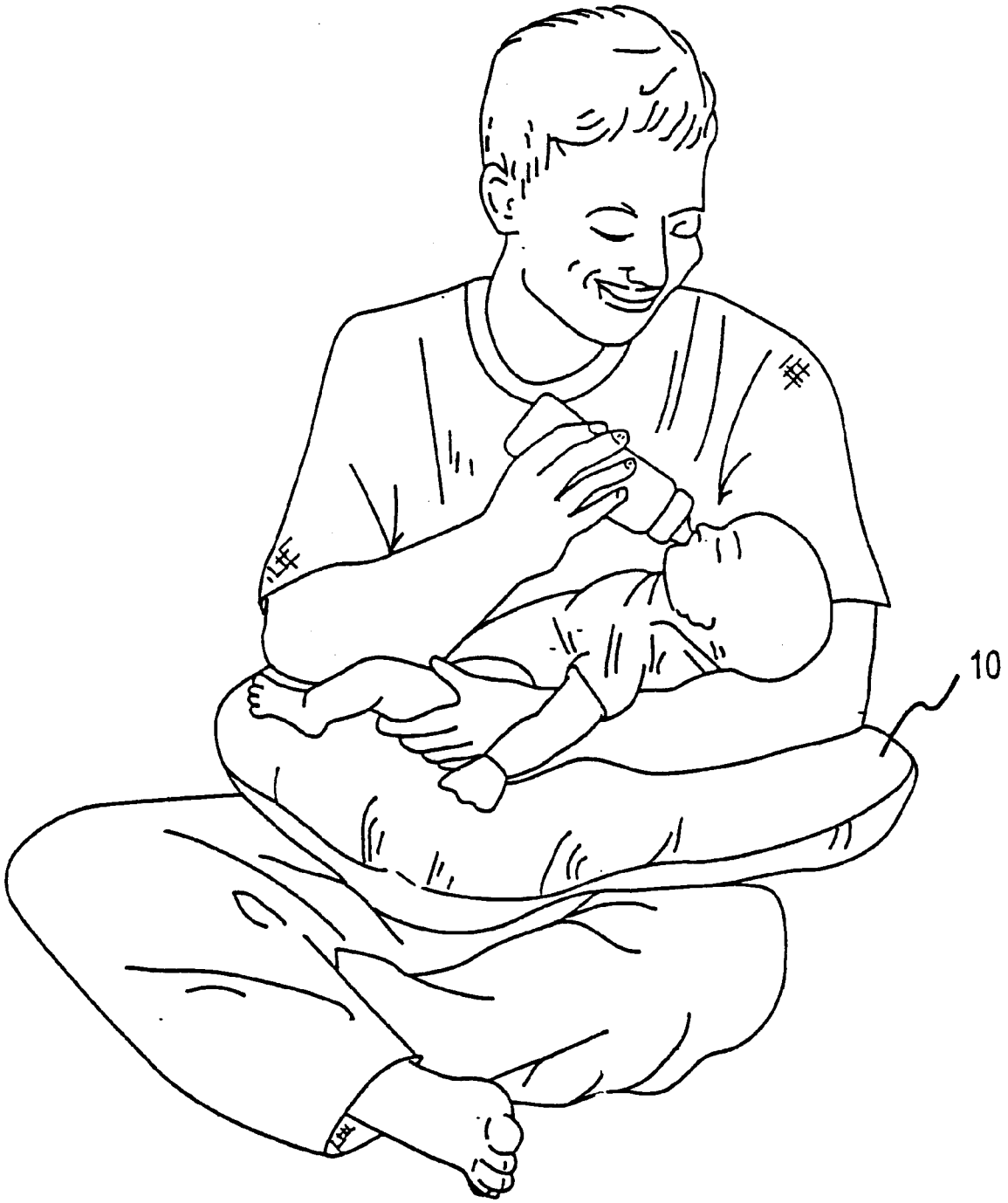
FIG. 6 illustrates the support pillow of FIG. 1 when used to facilitate the feeding of a baby according to the invention.

FIGS. 5 and 6 illustrate the use of support pillow 10 to facilitate breast feeding or bottle feeding of a baby. To do so, pillow 10 may be placed about the torso and may conveniently rest on the legs. The baby may then be held on medial region 15 while feeding or holding the baby.

Although described in connection with a center piece that is constructed of a non-stretchable fabric, it will be appreciated that certain modifications may be made. For example, the center piece may alternatively be constructed of an elastic or stretchable fabric. As another option, the center piece may be removed altogether, with the top and bottom pieces being gathered at the mid-plane. In this way, additional material is provided to permit the arms to be separated without tearing of the fabric.

The invention has now been described in detail for purposes of clarity and understanding. However, it will be appreciated that certain changes and modifications may be practiced within the scope of the appended claims.

What is claimed is:

1. A support pillow comprising:

a cushion body comprising a medial region and two opposing arms that define an outer perimeter and a generally open well, wherein the outer perimeter has a length of at least about 15 inches, wherein the arms may be separated from each other up to about at least 15 inches, and wherein the arms are configured to return to within about 8 inches of each other after the arms have been separated and released; and a cover disposed about the cushion body, wherein the cover comprises an outer section that extends about the outer perimeter and a seamless inner section that is coupled to the outer section and extends about the open well, wherein the inner section has a width in the range from about 1 inch to about 6 inches, wherein the outer perimeter has a length of at least about 15 inches, and wherein the seamless inner section is adapted to prevent tearing of the cover material adjacent the inner portion of the well upon separation of the arms.

2. A support pillow as in claim 1, wherein the cover is constructed of a generally non-stretchable fabric, and wherein the outer section and the inner section are sewn together.

3. A support pillow as in claim 2, wherein the outer section comprises a pair of fabric pieces that are sewn together at the outer perimeter.

4. A support pillow as in claim 1, wherein the medial region has a height in the range from about 4 inches to about 10 inches.

5. A support pillow as in claim 1, wherein the well has a diameter in the range from about 4 inches to about 12 inches when the arms are touching.

6. A support pillow as in claim 1, wherein the outer perimeter has a length of about 15 inches to about 45 inches, and wherein the arms may be separated from each other up to about 15 inches to about 45 inches.

7. A support pillow as in claim 1, wherein the cushion body is constructed of a polyester fill material.

8. A method for using a support pillow:

providing a support pillow comprising a cushion body having a medial region and two opposing arms that define an outer perimeter and a generally open well, and a cover disposed about the cushion body, wherein the cover comprises an outer section that extends about the outer perimeter and a seamless inner section that is coupled to the outer section and that extends about the open well, wherein the inner section has a width in the range from about 1 inch to about 6 inches;

separating the arms from each other to increase the size of the well, wherein the seamless inner section is adapted to prevent tearing of the cover material adjacent the inner portion of the well upon separation of the arms; and placing the arms about an object;

removing the support pillow from the object, whereupon removal the support pillow returns to a shape substantially the same as before being placed about the object and within about 8 inches from each other.

9. A method as in claim 8, further comprising separating the arms by a distance up to about 15 inches to about 45 inches.

10. A method as in claims 8, wherein the object comprises a human torso, and further comprising placing a baby onto the pillow.

11. A method for using a support pillow:

providing a support pillow comprising a cushion body having a medial region and two opposing arms that define an outer perimeter and a generally open well, and a cover disposed about the cushion body, wherein the cover comprises an outer section that extends about the outer perimeter and a seamless inner section that is coupled to the outer section and that extends about the open well, wherein the inner section has a width in the range from about 1 inch to about 6 inches;

separating the arms from each other to increase the size of the well, wherein the seamless inner section is adapted to prevent tearing of the cover material adjacent the inner portion of the well upon separation of the arms;

placing the arms about a human torso while the pillow is placed about the torso; and placing a baby onto the pillow.

* * * * *